US005355829A

United States Patent [19]

Waddell et al.

[11] Patent Number: 5,355,829

[45] Date of Patent: Oct. 18, 1994

[54] SUPPORT PLATFORM TO COVER AN OPEN COCKPIT PORTION OF A BOAT

[76] Inventors: Paul N. Waddell, 9790 SW. 157th Ter., Miami, Fla. 33173; Mark Hoven, 4345 SW. 72 Ave. Ste. G, Miami, Fla. 33155

[21] Appl. No.: 70,961

[22] Filed: Jun. 4, 1993

[51] Int. Cl.[5] ..... B63B 17/00

[52] U.S. Cl. ..... 114/361

[58] Field of Search ..... 114/343, 361, 364; 224/42, 46, 42.1 B; 135/119, 88

[56] References Cited

U.S. PATENT DOCUMENTS

| | | | |
|---|---|---|---|
| 2,493,833 | 1/1950 | Reynolds | 135/119 |
| 3,552,613 | 1/1971 | Nye | 114/343 |
| 4,641,600 | 2/1987 | Halvorsen | 114/361 |

FOREIGN PATENT DOCUMENTS

| | | | |
|---|---|---|---|
| 221136 | 6/1968 | Sweden | 135/119 |

*Primary Examiner*—Jesus D. Sotelo
*Attorney, Agent, or Firm*—Malloy & Malloy

[57] ABSTRACT

A support assembly for use in combination with a boat or like marine craft having an open cockpit or compartment area thereon wherein the support platform is disposed in overlying, covering relation to the open cockpit and is dimensioned, structured and configured to support one or more people thereon in either an upright or reclining position. The material from which the support platform is formed comprises an at least partially flexible, tightly woven polypropylene material which is secured in the aforementioned operative position by anchoring and connection facilities so as to maintain tension on the support platform and thereby provide the support platform with a substantially rigid configuration which will at least minimally yield to the weight of a person's body supported on the support platform over the open cockpit of the boat or marine craft.

24 Claims, 3 Drawing Sheets

SUPPORT PLATFORM TO COVER AN OPEN COCKPIT PORTION OF A BOAT

BACKGROUND OF THE INVENTION

1. Field of the Invention

This invention relates to a support platform removably disposed in overlying relation to an open compartment or cockpit area on a boat or like marine craft which is capable of supporting the weight of one or more persons thereon.

2. Description of the Prior Art

Certain modern day boats or like marine craft frequently include a hull design and structure comprising open compartments or "cockpit" areas which are provided to generally increase seating capacity or are utilized for other design and operational purposes. Boats or marine craft of this type are known as "open fisherman" and/or "bowrider" wherein the latter design the open cockpit area is located generally in the bow portion of the boat.

The increased popularity of such hull designs for these types of marine craft have presented the problem of conveniently and efficiently covering such open cockpit areas when such is desired and when the open cockpits are not in use.

The following U.S. Patents represent prior art designs which have attempted to provide some type of canopy, covering or like structure to overly the open cockpit areas for the reasons set forth above. More specifically, the U.S. Pat. No. to Yost, 4,092,754, discloses a boat interior and cabin design having a front open cockpit area which is covered in one preferred embodiment by flexible material soft top cover connected about peripheral portions thereof to the marine craft through the use of a plurality of snap-type fasteners. In another embodiment of the Yost patent, the cover or canopy is made from a somewhat harder rigid material having depending side walls and windows integrally formed therein. The connection of the harder type cover occurs over the open cockpit area in much the same way as the previous soft cover design. While the Yost canopy and/or cover is capable of its intended function, neither are specifically designed or capable or providing an adequate support platform which is substantially planer in configuration thereby not detracting from the intended lines and overall design of the marine craft.

The patent to Wills, U.S. Pat. No. 4,922,849, similarly discloses a bow cover for covering an open portion of the bow in an open-bow boat which includes a raised interior portion and a flared portion therearound with an inwardly directed opening through each. Wills provides a cover arrangement being fastenable to the interior portion and extending over the passageway to the bow of the boat. Again, while assumed to be operable for its intended function, Wills does not show a structure which is capable of being used primarily as a support platform to allow one or more people to be supported thereon whether in an upright position or a reclining position such as when sunbathing.

In other areas, basic soft or flexible material covers are of course well known to cover open compartment areas in vehicles. This is evidenced by the U.S. Pat. No. to Belk, 3,727,972. The Belk patent is directed to a cover to overlie the open bed of a pick-up truck or like vehicle. The cover includes a flexible sheet provided along its periphery with a plurality of openings to receiving complementary located and headed buttons secured about the periphery of the vehicle bed. The cover includes an elongated retainer embedded in the sheet periphery so as to extend along the sheet openings in position to underlie the button heads and thereby secure the cover in the desired, covering position. The Belk structure is designed merely to prevent access to the interior of the open bed of the truck-like vehicle and is not designed to provide any type of support platform of sufficient structural integrity to allow one or more people to be supported thereon.

Accordingly, there is an obvious need in the marine craft industry for a support platform having the structural integrity to support one or more people over an open cockpit or compartment area of a boat or like marine craft. Such a preferred structure should be capable of not only adequately overlying and covering the interior of the open cockpit but should have other favorable features such as easy attachment and detachment of the cover/support platform from its intended, operative position. Such a preferred structure should be formed of a material which may be inherently flexible but which is recognized as a high strength material, such as but not limited to tightly woven polypropylene, which when brought into a tensioned operative position overlying the aforementioned cockpit area, assumes a substantially rigid, planer configuration clearly capable of supporting more than one person in either an upright or reclined position.

SUMMARY OF THE INVENTION

This invention relates to a support platform specifically designed to overly and cover an open cockpit or like open compartment area in a boat or like marine craft. Typically, modern day boats are designed to have such open cockpit areas either in the bow or stern portions of the boats. While, as set forth above, prior art "coverings" do exist, such coverings are not specifically designed as a support platform. The present invention emphasizes structural features which allow it to be used as a support platform for one or more people whether in an upright, substantially standing position or a reclined position.

The support platform is preferably formed from a somewhat flexible material which when mounted in an operative position overlying the open cockpit area is maintained under sufficient tension to assume what would appear to be a "semi-rigid" orientation or configuration. Such tensioned mounting of the support platform occurs through specific structural details and more than one embodiment of an anchor means and a connection means.

The anchor means may take a variety of structural configurations preferably in the form of a plurality of anchor members which may be in the form of open faced hooks mounted in spaced relation to one another generally about the periphery of the open cockpit area. The hooks generally face outwardly so as to offer resistance to the connection facility attached to the support platform. It should be noted, and as will be emphasized hereinafter in greater detail, the anchor means may take the form of a variety of other structures of the type normally found on boats or marine craft or may take the form of specially mounted and secured anchor members generally of the type set forth above.

The connection means in one preferred embodiment, as set forth hereinafter, is in the form of an elongated cable mounted along a sleeve formed about and at least partially defining certain peripheral edges of the support platform. The sleeve has openings formed therein so as to expose the elongated cord found within the sleeve at various spaced apart locations along its length. The cord may protrude outwardly from the openings and be removably secured to the anchor members which, as set forth above, may be in the form of open faced hooks or the like. The cord or cable running through the peripheral sleeve of the support platform may preferably be maintained under tension by a spring also mounted within the sleeve and attaching segments of the elongated cord to one another. Forcing of the cord through the aforementioned openings out into removable engagement with the anchor members exerts a certain stretching or pulling force on the spring or springs thereby placing the cord under tension. This, is cooperatively structured along with the dimension and configuration of the support platform to provide an overall tension on the support platform when in its operative position. The operative position of the support platform may be defined by a substantially planer configuration in overlying, covering relation to the open cockpit or compartment of the marine craft.

As set forth above, the anchor means may be in the form of structures normally found on modern day boats. Such structures may include a bow or "rub" railing in circling the periphery of the open cockpit. Alternately, the anchor means may be defined by a plurality of anchor members each of which may be defined by existing cleats on the exposed deck or surface of the boat. Such cleats are normally used for tie-off lines or the like. Similarly, instead of an elongated cord extending about the periphery of the support platform, the connection means may take the form of a plurality of tie segments having one end secured to the periphery of the support platform and an outer or free end removably attached to either the rub rail or the cleats, depending upon the embodiment of the invention utilized.

Added or regulated tension can also be applied through other variations and the connections means. Such variations can be in the form of a turnbuckle type structure which has one outer free end attached to a connector element which itself is removably secured to one of the aforementioned anchor members. The turnbuckle arrangement is capable of having its length adjusted thereby regulating the overall length and/or distance between the perimeter of the support platform and the anchor member or members. Adequate tension can be applied by in effect shortening the length of the perimeter to which the turnbuckle assembly is attached thereby increasing the overall tension to the desired amount to accomplish the operative positioning of the support platform into a substantially planer, flat configuration.

It should be emphasized that the support platform may be removably disposed in covering relation to either an open compartment of cockpit located either in the bow of the boat or marine craft or the stern thereof. Depending upon the location of the support platform, again the connection means and anchor means may in fact vary or differ. Specifically relating to a stern-positioned support platform, the connection means comprises two opposed brackets in the form of an elongated support portion formed of a metallic, rigid plastic or like high-strength material having two depending legs formed on opposite ends thereof. The depending legs are specifically configured and structured to define the free ends of such brackets and are further configured to fit within receiving sockets integrally formed in the opposite sides of the boat. Typically, such receiving sockets are found in such boats and used to support fishing rods or other utensils used on boats or marine craft.

Yet other embodiments of the connection means and anchor means allow a central base portion of the support platform to have more "spring" or yield to the one or more people supported thereon. In such embodiments, a plurality of spaced apart springs, such as coil springs, may have opposite ends attached between outer peripheries of the base portion and a surrounding border segment secured to the marine craft. The base portion is maintained under a certain amount of tension due to the existence of the spaced apart springs which provide a resiliency to the base portion.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 24:
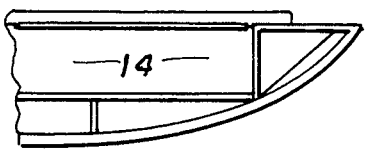
FIG. 24 is a longitudinal sectional view in partial cut-away with interior details of the boat or marine craft on which the subject invention is mounted.

As shown in the accompanying drawings, the present invention is directed towards a support assembly generally indicated as 10 of the type to be used in combination with a boat or like marine craft generally indicated as 12 particularly wherein the boat or marine craft has one or more open compartments or cockpit areas as at 14 (see FIG. 24). Specifically, the support platform 10 is formed of a flexible material which when mounted in its operative position assumes a substantially flat, semi-rigid, planar configuration as demonstrated throughout the figures hereinafter. The aforementioned operative position is defined by the support assembly 10 being maintained under tension in overlying and covering relation to the open cockpit or compartment area 14. As will also be explained in greater detail, the proper amount of tension is placed on the support platform 10 such that it is capable of supporting one or more people thereon wherein such people may be oriented in either a reclined or an upright, standing position. In the preferred embodiment of the present invention, the support platform 10 is preferably formed from a tightly woven polypropylene material similar or equivalent to the material used in the beds of high quality trampolines. Therefore, the material is also preferably porous because of the tightly woven configuration in the formation of the support platform 10.

An anchor means may take a variety of different embodiments as discussed hereinafter, but is normally found permanently or otherwise fixedly mounted on the marine craft in somewhat surrounding and preferably spaced relation to the perimeter of the open cockpit or compartment 14. This anchor means cooperates with a connecting means, also having a plurality of different embodiments, secured to the outer periphery of the support platform 10 in a manner wherein the location of the connecting means corresponds with the location of the anchoring means for removable interconnection of the connecting means to the anchoring means and proper tensioned support of the support platform in its operative position as defined above.

Figure 1:
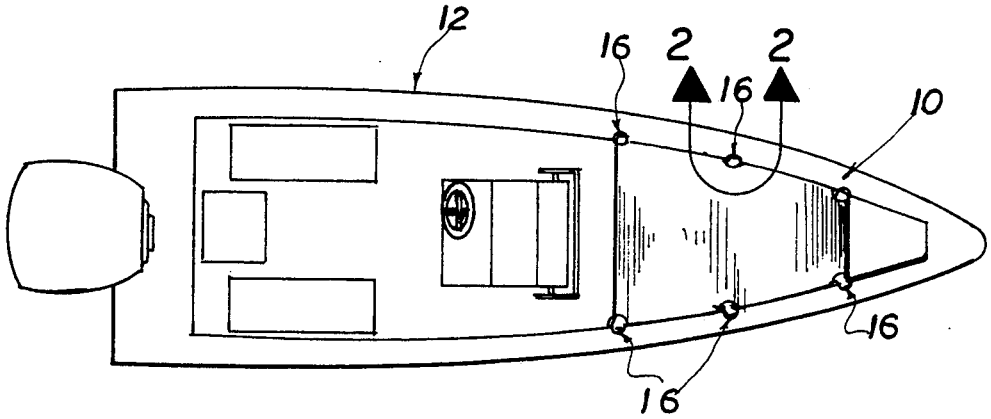
FIG. 1 is a top view of one preferred embodiment of the present invention.
Figure 2:
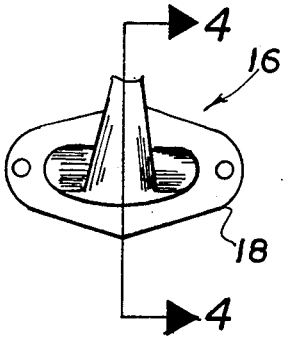
FIG. 2 is a detailed view of an anchor member associated with the embodiment of FIG. 1 along line 2—2 of FIG. 1.
Figure 4:
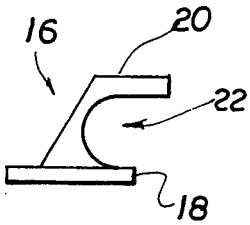
FIG. 4 is a sectional view along line 4—4 of FIG. 2.
Figure 3:
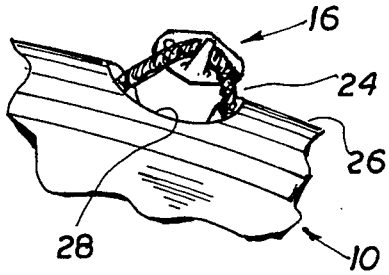
FIG. 3 is a detailed view in partial cut-away showing attachment of a support platform or base portion to an anchor member of FIG. 2.
Figure 5:
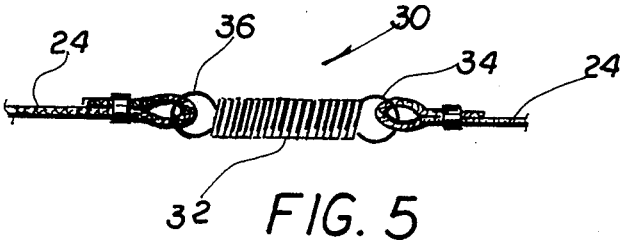
FIG. 5 is a detailed view in partial cut-away of other features of the embodiment of FIG. 1.

With reference to FIGS. 1 through 5, one preferred embodiment of the present invention comprises the anchor means comprising a plurality of anchor members generally indicated as 16 and being structured in the form of open-faced hooks as shown in FIGS. 2 and 3. The anchor hooks 16 include a base as in 18 fixedly secured in surrounding relation to the open cockpit and directly to an exposed surface of the deck as shown in FIGS. 1, 2 and 3. The anchor hooks 16 include an outstanding hook portion as at 20 integrally formed to the base 18 and extending outwardly therefrom. The open facing or inner space of the hook as at 22 generally faces outwardly away from the operative position of the support platform 10 as shown in FIG. 3. Each of the anchor members 16 are disposed and structurally adapted to cooperate and removably support the connector means. In the embodiment of FIGS. 1 through 5 the connector means comprises an elongated cord, rope or like element as at 24 having a majority of its length extending within and along a peripheral sleeve 26 having a hollow configuration along its length. The peripheral sleeve 26 extends at least along a majority of the peripheral edge of the support platform 10. The cord 24, however, is exposed and further is allowed to protrude outwardly from spaced apart openings as at 28 formed in the sleeve 26, again in spaced relation about the periphery of the support platform 10. The openings 28 correspond to the location of the various hook anchors 16. The cord portions 24 protruding outwardly from the openings 28 may be looped around and entered the open recess or facing as at 22 so as to be removably supported thereon. Placement of the cord 24 about each of the anchor hooks 16 serves to provide proper tension and positioning of the support platform 10 in its operative position. Adequate tension is supplied to the cord by the insertion of a tensioning means generally indicated as 30. The tensioning means, in this embodiment, is in the form of an elongated coil spring 32 having its opposite ends as at 34 and 36 engaging free ends of the cord 24 as clearly shown in FIG. 5. The disposition of the tensioning spring 32 is such as to be on the interior of a portion or length of the sleeve 26 somewhere along the length of the cord 24. The structure of the spring 32 is such as to put adequate tension on the entire cord 24 such that it has to be somewhat forced out of the respective openings 28 into a tensioned but removable engagement with the hook anchors 16.

Figure 6:
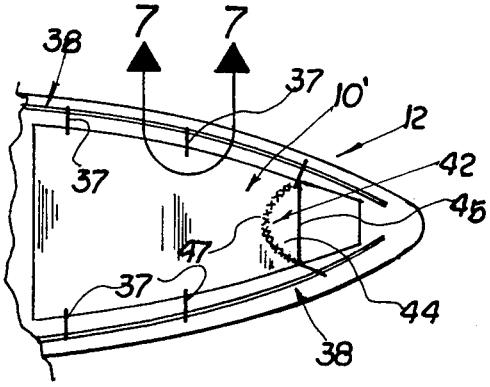
FIG. 6 is a top view in partial cut-away of yet another embodiment of the present invention.
Figure 7:
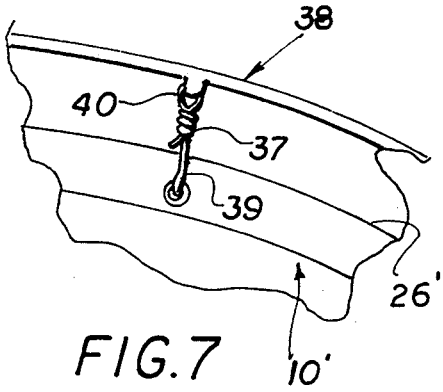
FIG. 7 is a detailed view in partial cut-away along line 7—7 of another embodiment of the anchor structure associated therewith.

Yet another embodiment shown in FIGS. 6 and 7 wherein the support platform 10' comprises a connection means in the form of a plurality of spaced apart tie segments as at 37. Each of the tie segments has one end as at 39 fixedly secured or attached to the peripheral edge as at 26' and extending outwardly therefrom. The opposite or free end as at 40 is structurally adapted to be tied or otherwise affixed to a bow rail or rub rail generally indicated as 38. Therefore, the bow rail 38 is of the type normally found mounted about the bow of boats or marine craft and extends upwardly therefrom by means of a plurality of dependent legs or the like. Each of the tie segments 37 is therefore removably secured at its free end 40 to one of the depending legs or to any other appropriate part of the bow rail 38. The bow rail obviously defines the anchor means instead of the plurality of the anchor hooks 16 with regard to the embodiment of FIGS. 1 through 5.

Another feature associated with the embodiments of FIGS. 6 and 7 is the existence of a hatch structure generally indicated as 42. The hatch structure includes a flap 44 mounted on and considered generally a part of the support platform 10'. The flap 44 has one peripheral edge integrally or otherwise attached as at 45 to form a hinge about which the rest of the flap may be pivoted or positioned. An outer peripheral portion of the flap 44 as at 47 may include an elongated zipper type attachment or other attachment which allows the easy connection and disconnection of the peripheral edge 47 from the remainder of the support platform 10'. The flap may therefore be moved to an open position to provide access to the area within the interior of the open compartment 14 beneath the support platform 10' for purposes of providing access to various articles such as an anchor or for other reasons.

Figure 8:
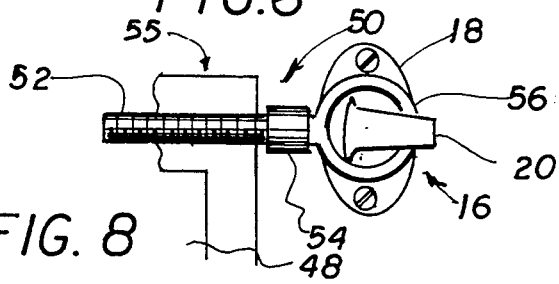
FIG. 8 is a detailed view in partial cut-away along line 8—8 of FIG. 9.
Figure 9:
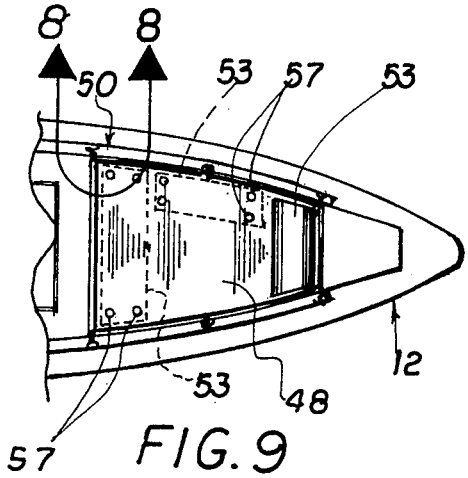
FIG. 9 is a top view in partial cut-away of yet another embodiment of the present invention.

Yet another embodiment is shown in FIGS. 8 and 9. In such an embodiment, the support platform 48 is similarly structured to the embodiments of FIGS. 1 and 2 in the sense of being formed from the same material. However, the connecting means comprises in addition to the elongated cord 24 formed within the peripheral sleeve 26, a tightening assembly primarily in the form of a turnbuckle assembly generally indicated as 50 in FIG. 8. The turnbuckle assembly 50 includes one elongated attachment member 52 having an externally threaded surface. An internally threaded collar as at 54 is movably and threadedly secured thereto and also rotationally secured to a ringlike connector element 56. However, the collar 54 moves with the connector element 56 relative to the member 52. Rotation of the collar 54 in the appropriate direction will regulate the position of both the collar 54 and the connector member 56 along the length of the externally threaded attachment member 52. Since the attachment member 52 is attached to one peripheral edge generally indicated as 55 of the support platform 48, the distance between the peripheral edge 55 and the hook type anchor 16 may be varied. This in turn will serve to regulate the tension on the support platform 48 and particularly the distance and overall length of the peripheral edge 55 from the corresponding anchor 16 once the connector element is secured to the anchor 16. It is apparent that the turnbuckle assembly 50 defining the connection means may be regulated so that the tension on the support platform 48 is properly regulated to orient and maintain the support platform 48 in the aforementioned tensioned, operative position.

Other features associated with the embodiment of FIGS. 8 and 9 include the removable attachment or mounting of pillow members 53 thereon. Such pillow members may be attached by a Velcro or snap-type connectors as at 57 mounted on exposed surfaces of the support platform 48 as clearly shown in FIG. 9. The position of the pillows as at 53 may be varied. The size and configuration of individual ones of the pillows 53 may also vary depending upon the particular location on the exposed surface 48 of the platform wherein such pillows are intended to be located.

Figure 11:
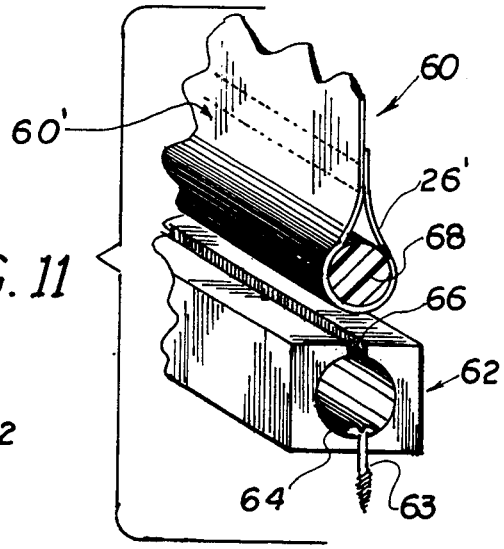
FIG. 11 is a perspective view in partial cut-away and section along line 11—11 of FIG. 10.
Figure 10:
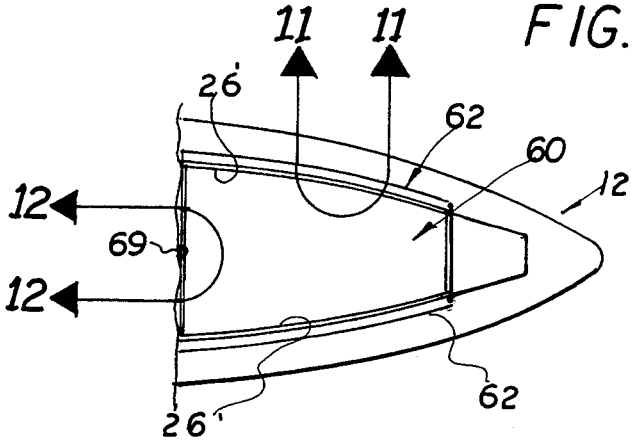
FIG. 10 is a top view in partial cut-away of yet another embodiment of the present invention.
Figure 12:
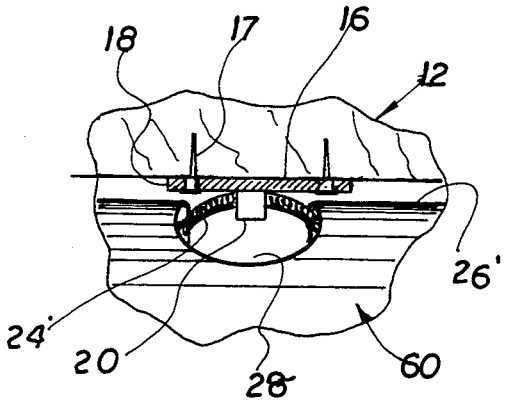
FIG. 12 is a detailed view in perspective and cutaway along line 12—12 of FIG. 10.

Yet another embodiment of the present invention is represented in FIGS. 10 through 12. In this embodiment, the support platform 60 is formed of the same material as the previously described embodiments. However, the anchor means and cooperating connection means is shown in detail in FIGS. 11 and 12. More specifically, the anchor means comprises a sleeve structure generally indicated as 62 affixed by any appropriate connector as at 63 to the marine craft 12 in spaced and generally adjacent relation to the periphery of the open cockpit 14. The channel structure 62 has an elongated interior channel as at 64 formed therein and extending along the length thereof. In addition, an elongated slot as at 66 is integrally formed in the channel structure 62 and also extends along its length in direct communication with the interior 64 thereof. It is of course noted that the transverse dimension or width of the elongated slot or passage is significantly less than that of the interior channel 64. The connection means associated with the present embodiment includes an elongated mounting rod or the like 68 formed within the sleeve 26' which defines a peripheral edge or at least a majority of the entire surrounding periphery of the support platform 60. The rod 68 is dimensioned and configured to fit within the interior of the sleeve 26' and be maintained therein. In addition, the rod and sleeve 68 and 26' respectively are positioned on the interior of the elongated channel 64 and are maintained therein by virtue of their relative configurations. When so positioned, the surrounding area as at 60' of the support platform 60 passes through the elongated slot 66. Obviously, the slot 66 is too small to allow passage therethrough of the rod 68. The surrounding peripheral edge of the support platform 60 is therefore maintained in a tensioned engagement with the anchoring means defined by the channel structure 62.

As part of this embodiment, a secondary anchoring member as at 16 is affixed or mounted to a portion of the marine craft 12. The anchoring member 16 is similar to that shown in the embodiment of FIGS. 2 and 4 and includes the hook portion 20 integrally mounted on the base 18 wherein the base in connected by conventional connector members 17 as shown. Also in this embodiment, a supplementary connection means comprises the aforementioned and described cord 24' extending through the opening 28' in the support platform 60 immediately adjacent the peripherally disposed sleeve 26'. Therefore, a vast majority of the length of the periphery of the support platform 60 is secured in its operative position under tension so as to maintain the support platform in a substantially flat, planar configuration for proper support of one or more people thereon in overlying relation to the open cockpit 14.

Figure 13:
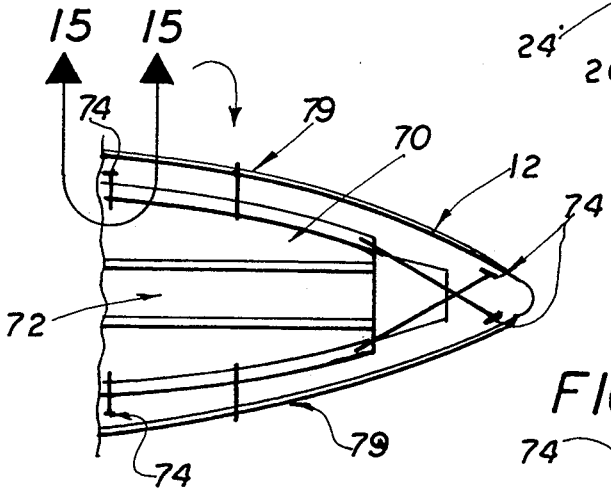
FIG. 13 is a top view in partial cut-away of yet another embodiment of the present invention.
Figure 14:
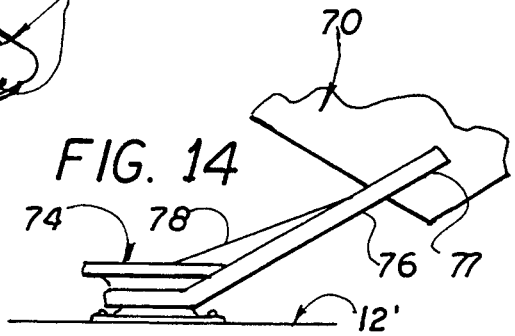
FIG. 14 is a perspective view in partial cut-away of certain structures of the embodiment of FIG. 13.
Figure 15:
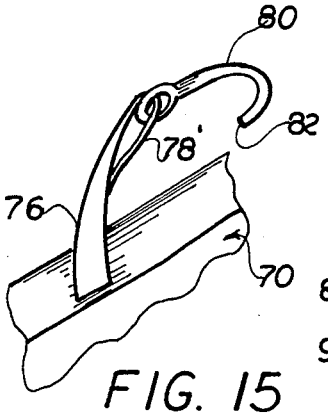
FIG. 15 is a perspective view in partial cut-away along line 15—15 of FIG. 13.

In another preferred embodiment of the present invention as shown in FIGS. 13 through 15 wherein the support platform 70 is formed in large part from the same tightly woven polypropylene material as in the rest of the previously described embodiment. However, in addition, the support platform 70 includes a substantially elastic material strip as at 72 being somewhat centrally located and extending along a majority of the length thereof. This strip provides greater flexibility and resiliency to the overall support platform 70 and allows its use for a variety of functions while still being able to support one or more people in an upright orientation or in a reclined position.

In this embodiment, the anchoring means comprises in part the plurality of cleats 74 normally found mounted on a deck 12' of the marine craft 12 and commonly used for the purpose of tying off lines, ropes, etc. These cleats are typically disposed as shown in FIG. 13 in generally spaced relation to the open cockpit 14 as shown. The connection means used in cooperation with the anchoring cleats 74 comprises a plurality of tie members or segments as at 76 having one end fixedly mounted on a peripheral portion of the support platform 70 as at 77. The opposite or free end as at 78 is formed into a loop type configuration in surrounding but removable engagement to the cleats 74 typically when such cleats are in a conventional configuration. A supplementary anchor means may be defined by an outboard ridge or edge indicated in FIG. 13 as 79 which is an integral part of the marine craft. The connection means associated therewith and cooperatively structured to engage such ridge 79 is a similar type of tie 76 having its outermost free end formed into a loop like configuration 78' but further including a movable grasping hook as at 80. The grasping hook is bent in a typical hook configuration such that the distal free end thereof 82 grips, under tension, the protruding, outboard peripheral ridge or edge 79 of the marine craft 12 as best shown in FIG. 13.

Figure 16:
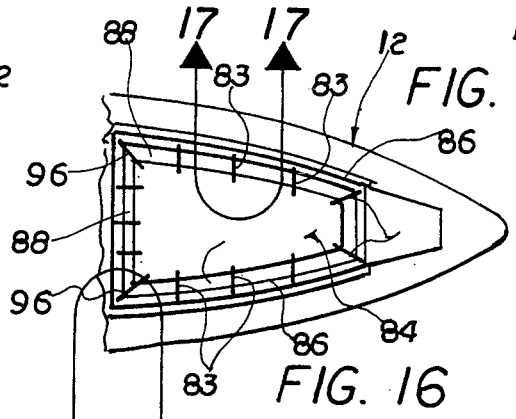
FIG. 16 is a top view in partial cut-away of yet another embodiment of the present invention.
Figure 17:
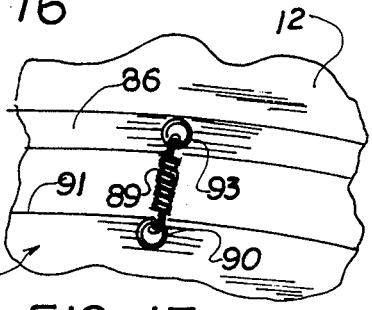
FIG. 17 is a detailed view in partial cut-away along line 17—17 of FIG. 16.

Yet another preferred embodiment of the present invention is shown in FIGS. 16 through 21. In this embodiment, the support platform includes a central base portion 84 surrounded by a border segment 86 which is fixedly but removably secured to the surrounding area of the cockpit 14 and directly to the marine craft 12. There is an existing intended space as at 88 totally surrounding the centrally disposed base portion 84. A plurality of connecting members, in the embodiment of FIGS. 16 and 17, are in the form of a plurality of spaced apart springs as at 89 having one end 90 secured to the periphery 91 of the base 84 and extending outwardly therefrom into connection with the border segment 86 at the opposite end 93. The springs 89 may be of a variety of configurations, but, as shown, in this embodiment are a plurality of coil springs. The existence of these springs serving as connector members provide a much more resilient and flexible action to the base portion relative to the surrounding border segment 86.

Figure 18:
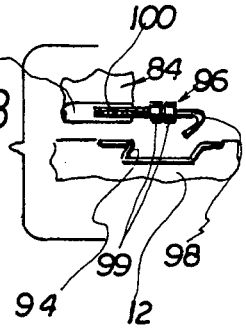
FIG. 18 is a detailed view in partial exploded form and cut-away along line 18—18 of FIG. 16.

As a supplementary connection means and anchoring means, reference is made to FIG. 18. In this figure a supplementary anchor means in the form of a reinforced recess as at 94 fixedly formed in the deck of the marine craft 12 as shown. This recess is disposed to cooperative with a turnbuckle assembly similar to that of the embodiment of FIG. 8. The turnbuckle assembly generally indicated as 96 includes a connecting hook as at 98 and revolving nuts 99 movable with the hook 98 relative to a corner portion 101 of the base 84 and being internally threaded. The nuts 99 are threadedly attached to move along the length of the externally threaded rod or shaft 100. The shaft 100 is fixedly secured to a corner portion as at 101 of the base portion 84 of the support platform. Therefore, each of the turnbuckle assemblies 96 may be adjusted in order to vary the distance between the corner portion 101 and the hook 98. When the hook 98 is mounted within recesses 98 attached to the marine craft 12, the distance the corner portion and the recess may be varied. The tension on the base portion 84 so as to maintain the base 84 may therefore be varied under the proper tension while still providing a certain amount of trampoline type activity and a bouncing action as described above.

Figure 20:
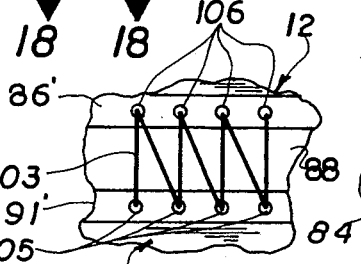
FIG. 20 is a top view in partial cut-away and detail along line 20—20 of FIG. 19.
Figure 19:
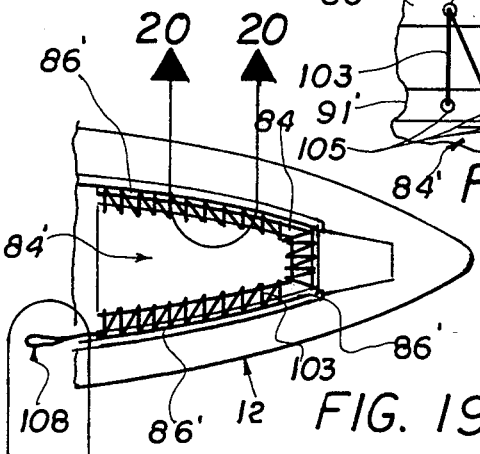
FIG. 19 is a top view in partial cut-away of yet another embodiment of the present invention.
Figure 21:
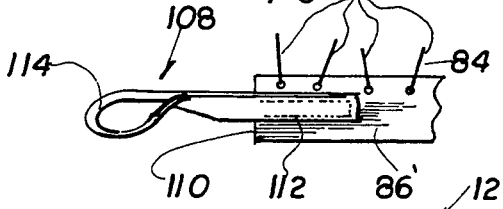
FIG. 21 is a detailed view in partial cut-away along line 21—21 of FIG. 19.

A modification of the embodiments of FIGS. 16 through 18 is found in FIGS. 19 and 20. In this embodiment, the springs 89 are replaced by a connecting lacing type structure wherein a cord or like member 103 is continuously laced through spaced apart apertures 105 and 106 formed respectively in the peripheral edge portions 91' and 86' of the base 84' and of the border segment 86'. As in FIG. 19, the lacing is continued about a vast majority of the periphery of the base portion 84 and serves as interconnection across the space 88. Sufficient tensioned support of the base portion 84' is maintained while not as much resiliency or "bounce" is provided with the embodiment of FIG. 19 relative to the embodiment of FIG. 16.

Yet another feature associated with the embodiment of FIG. 19 is a positioning handle generally indicated as 108. The positioning handle is formed on the free end 110 of the border segment 86'. The positioning handle has one end as at 112 affixed as shown and an opposite or free end formed into a gripping type handle or loop configuration 114. The handle is used to exert a pulling force on the border segment 86' to properly position it for fixed but removable attachment to the marine craft 12 generally adjacent to spaced from the periphery of the open cockpit 14.

Figure 22:
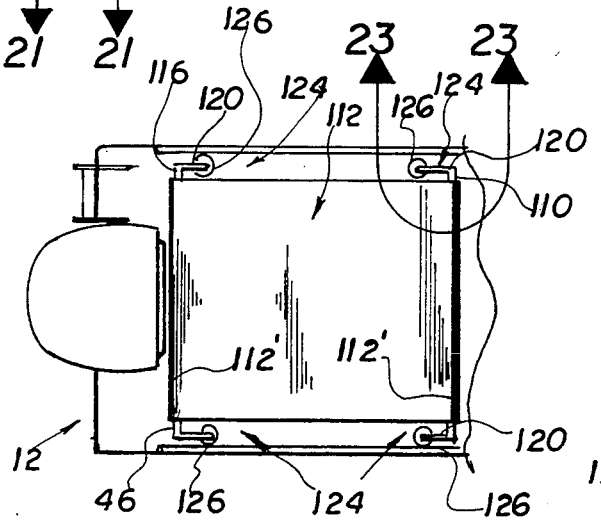
FIG. 22 is a top view in partial cut-away of yet another embodiment of the present invention.
Figure 23:
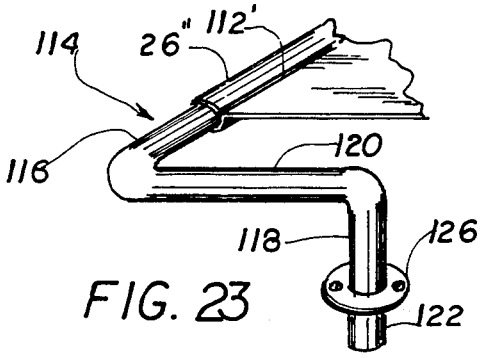
FIG. 23 is a detailed view in perspective and cutaway along line 23—23 of FIG. 22.

Yet another preferred embodiment of the present invention is shown in FIGS. 22 and 23 wherein the support platform 112 is disposed in overlying, covering relation to an open cockpit located and formed in the rear of the marine craft 12. In this embodiment the connection means comprises at least two spaced apart support brackets generally indicated as 114. Each of the support brackets comprises an elongated support portion 116 formed of a relatively high-strength material such as metal, plastic or the like secured by a sleeve 26" to opposite peripheral sides 112' of the support platform 112. Each of the support brackets in addition includes depending leg portions as at 118 connected to the support portion by a connecting link 120. The depending leg portions have a free end as at 122 designed to fit within receiving pockets formed in the surrounding portions as at 124 on the marine craft, clearly shown in FIG. 22. The free ends extend outwardly from a stop member as at 126 also fixedly secured to the depending legs 118. The stop member limits the depth which the free end 122 passes into the receiving pockets generally indicated as 124. The receiving pockets 124 may normally be found in the boat and used conventionally to support fishing poles or like apparatus associated with the marine craft 12. Alternately, the receiving pockets may be especially formed and located so as to receive the depending legs 118 and more particularly the free ends 122 therein for a tensioned support of the support platform 112 in overlying relation to an open compartment or cockpit located in the stern of the marine craft 12. These receiving pockets clearly define the aforementioned anchoring means.

Now that the invention has been described,

What is claimed is:

1. A support assembly for supporting one or more people above an open cockpit or compartment area of a marine craft, said assembly comprising:

a) a support platform demensioned and configured to overlie at least a majority of the open cockpit in covering relation to an interior thereof, b) anchor means for securing the support platform being attached to the marine craft in substantially surrounding relation to the open cockpit and adjacent a periphery thereof, c) connection means for connecting said support platform to said anchor means and being mounted along a periphery of said support platform, d) said connection means cooperatively disposed and structurally adapted relative to said anchor means to maintain tension on and orient said support platform in an operative position defined by a substantially flat, planar configuration thereof over the open cockpit, e) said anchor means comprising a plurality of anchor members mounted on the marine craft in spaced relation to one another about a periphery of the open cockpit, said anchor members structured to have said connection means removably attached thereto, f) said connection means comprising an elongated cord secured within and extending along a major length of a periphery of said support platform, said cord exposed through openings in said periphery of said support platform at spaced apart locations along the length of said cord corresponding to locations of said plurality of anchor members, said cord extending through each of said openings into removable, supported connection with corresponding ones of said anchor members, and g) biasing means secured to said cord and mounted on said support platform for providing tension on said cord when disposed into removable engagement with said anchor members.

2. An assembly as in claim 1 wherein said support platform is formed from a sheet of semi-flexible material oriented in said operative position to define a configuration of sufficient rigidity to support one or more people in either an upright or reclining position.

3. An assembly as in claim 2 wherein said support platform is formed from a sheet of porous material.

4. An assembly as in claim 3 wherein said support platform is formed from a sheet of tightly woven polypropylene material.

5. An assembly as in claim 1 wherein each of said anchor means comprises a hook structure having an open receiving slot facing outwardly from the open cockpit and away from said support platform.

6. An assembly as in claim 1 wherein said support platform comprises an elongated sleeve extending along said periphery of said support platform in substantially enclosing relation to said cord, said openings formed within said sleeve in spaced relation to one another and in substantially aligned relation to said plurality of anchor members.

7. A support assembly for supporting one or more people above an open cockpit or compartment area of a marine craft, said assembly comprising;

a) a support platform dimensioned and configured to overlie at least a majority of the open in cockpit in covering relation to an interior thereof, b) anchor means for securing the support platform being attached to the marine craft in substantially surrounding relation to the open cockpit and adjacent a periphery thereof, c) connection means for connecting said support platform to said anchor means and being mounted along a periphery of said support platform, d) said connection means cooperatively disposed and structurally adapted relative to said anchor means to maintain tension on and orient said support platform in an operative position defined by a substantially flat, planar configuration thereof over the open cockpit, e) said connection means comprising an adjustable connector assembly secured to one elongated peripheral side of said support platform and extending outwardly therefrom into removable engagement with said anchor means, said connector assembly structurally adapted to vary its length and regulate the distance of said one peripheral side from side anchor means whereby the tension on said one peripheral side, when connected to said anchor means, may be regulated.

8. An assembly as in claim 7 wherein said adjustable connection assembly comprises a turnbuckle assembly extending longitudinally along the length of said one peripheral side and structured to vary the distance between said one peripheral side and said anchor means.

9. A support assembly for supporting one or more people above an open cockpit or compartment area of a marine craft, said assembly comprising;

a) a support platform dimensioned and configured to overlie at least a majority of the open cockpit in covering relation to an interior thereof, b) anchor means for securing the support platform being attached to the marine craft in substantially surrounding relation to the open cockpit and adjacent a periphery thereof, c) connection means for connecting said support platform to said anchor means and being mounted along a periphery of said support platform, d) said connection means cooperatively disposed and structurally adapted relative to said anchor means to maintain tension on and orient said support platform in an operative position defined by a substantially flat, planer configuration thereof over the open cockpit, e) pillow means removably secured to an exposed, supporting surface of said support platform for supporting a part of a persons body inclined on said support platform.

10. A support assembly for supporting one or more people above an open cockpit or compartment area of a marine craft, said assembly comprising;

a) a support platform dimensioned and configured to overlie at least a majority of the open cockpit in covering relation to an interior thereof, b) anchor means for securing the support platform being attached to the marine craft in substantially surrounding relation to the open cockpit and adjacent a periphery thereof, c) connection means for connecting said support platform to said anchor means and being mounted along a periphery of said support platform, d) said connection means cooperatively disposed and structurally adapted relative to said anchor means to maintain tension on and orient said support platform in an operative position defined by a substantially flat, planar configuration thereof over the open cockpit, e) a hatch assembly formed in said support platform and comprising a flap movable between a closed position and an open position, said closed position defined by securement of said flap in substantially co-planer relation to a remainder of said support platform.

11. An assembly as in claim 10 wherein said open position is defined by a length of a peripheral edge of said flap separated from a remainder of said support platform and a resulting passage formed in said support platform communicating with an interior of the open cockpit beneath the support platform.

12. An assembly as in claim 11 further comprising attachment means removably securing said peripheral edge of said flap to said support platform when in said closed position.

13. A support assembly for supporting one or more people above an open cockpit or compartment area of a marine craft, said assembly comprising;

a) a support platform dimensioned and configured to overlie at least a majority of the open cockpit in covering relation to an interior thereof, b) anchor means for securing the support platform being attached to the marine craft in substantially surrounding relation to the open cockpit and adjacent a periphery thereof, c) connection means for connecting said support platform to said anchor means and being mounted along a periphery of said support platform, d) said connection means cooperatively disposed and structurally adapted relative to said anchor means to maintain tension on and orient said support platform in an operative position defined by a substantially flat, planar configuration thereof over the open cockpit, e) said anchor means comprising an elongated channel structure secured to the marine craft and extending adjacent to a length of the periphery of the open cockpit; said connection means including an elongated rod secured to and extending along at least one peripheral edge of said support platform, said rod structurally adapted to fit within an interior of said channel structure and be removably retained therein while secured to said peripheral edge of said support platform, f) at least a majority of the length of said rod being slidably received within said channel structure, an elongated slot of lesser transverse dimension than said rod being formed on said channel structure in communication with said interior and being disposed to allow passage of said support platform therethrough wherein said rod is disposed within said interior of said channel structure, and g) said channel structure and said rod extending along a majority of the periphery of said open cockpit and said support platform respectively, a free peripheral edge of said support platform absent said rod being removably secured to said anchor means independently of said channel structure.

14. A support assembly for supporting one or more people above an open cockpit or compartment area of a marine craft, said assembly comprising;

a) a support platform dimensioned and configured to overlie at least a majority of the open cockpit in covering relation to an interior thereof, b) anchor means for securing the support platform being attached to the marine craft in substantially surrounding relation to the open cockpit and adjacent a periphery thereof, c) connection means for connecting said support platform to said anchor means and being mounted along a periphery of said support platform, d) said connection means cooperatively disposed and structurally adapted relative to said anchor means to maintain tension on and orient said support platform in an operative position defined by a substantially flat, planar configuration thereof over the open cockpit, e) said support platform comprising an elongated base segment substantially centrally disposed and extending between substantially oppositely disposed peripheral edges of the cockpit, said base segment formed of a flexible material having substantially greater resiliency than a remainder of said support platform.

15. An assembly as in claim 14, wherein said support platform comprises a border segment secured to the marine craft in substantially surrounding, adjacent relation to the periphery of the open cockpit and a base portion centrally disposed in inwardly spaced relation to said border segment; and an attachment assembly interconnecting said base portion to said border segment and disposed across an elongated spacing therebetween, said elongated spacing extending between said border segment and a majority of the length of an outer periphery of said base portion.

16. An assembly as in claim 15 wherein said attachment assembly comprises an elongated cord laced transversely across said elongated spacing in interconnecting relation to correspondingly positioned edges of said border segment and said base portion.

17. An assembly as in claim 15 wherein said attachment assembly comprises a plurality of springs disposed in spaced relation to one another and extending transversely across said elongated spacing and each spring having an opposite end thereof secured to a correspondingly positioned edge of said border segment and said base portion.

18. An assembly as in claim 17 wherein said plurality of springs are disposed and adapted to provide resiliency to said base portion.

19. An assembly as in claim 15 further comprising a handle member mounted on one free end of said border segment and extending outwardly therefrom, said handle member adapted to position said border segment relative to said anchor means when pulling force is exerted thereon to place the desired tension on said base portion.

20. An assembly as in claim 19 wherein a free end of said handle is configured and disposable to removably engage said anchor means for maintenance of said support platform in a preferred position.

21. A support assembly for supporting one or more people above an open cockpit or compartment area of a marine craft, said assembly comprising;

a) a support platform dimensioned and configured to overlie at least a majority of the open cockpit in covering relation to an interior thereof, b) anchor means for securing the support platform being attached to the marine craft in substantially surrounding relation to the open cockpit and adjacent a periphery thereof, c) connection means for connecting said support platform to said anchor means and being mounted along a periphery of said support platform, d) said connection means cooperatively disposed and structurally adapted relative to said anchor means to maintain tension on and orient said support platform in an operative position defined by a substantially flat, planar configuration thereof over the open cockpit, e) said connection means comprising at least two spaced apart brackets formed from a substantially rigid, high strength material, and each bracket secured to a different one of two oppositely disposed peripheral edges of said support platform, each of said brackets disposed and configured to be removably connected to said anchor means on the marine craft.

22. An assembly as in claim 21 wherein said anchor means comprises a plurality of receiving sockets formed in the marine craft and each being dimensioned to receive a free, outwardly extending end of said bracket therein.

23. An assembly as in claim 22 wherein the open cockpit is disposed aft of a bow of the marine craft and said receiving sockets are dimensioned to also receive fishing poles therein.

24. An assembly as in claim 22 wherein each bracket comprises an elongated support portion secured to one side of said support platform and two depending legs each formed on a different end of said support portion and extending outwardly and downwardly therefrom, each leg defining a different free end of said bracket being dimensioned and configured to be received within one of said receiving sockets.

* * * * *